US011289251B2

(12) United States Patent
Kwon et al.

(10) Patent No.: US 11,289,251 B2
(45) Date of Patent: Mar. 29, 2022

(54) COIL COMPONENT

(71) Applicant: SAMSUNG ELECTRO-MECHANICS CO., LTD., Suwon-Si (KR)

(72) Inventors: Sang Kyun Kwon, Suwon-Si (KR); Han Wool Ryu, Suwon-Si (KR); Chang Hak Choi, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 800 days.

(21) Appl. No.: 16/013,588

(22) Filed: Jun. 20, 2018

(65) Prior Publication Data

US 2019/0122793 A1 Apr. 25, 2019

(30) Foreign Application Priority Data

Oct. 20, 2017 (KR) ..... 10-2017-0136768

(51) Int. Cl.
*H01F 1/147* (2006.01)
*B22F 1/00* (2006.01)
(Continued)

(52) U.S. Cl.
CPC ..... *H01F 1/147* (2013.01); *B22F 1/0018* (2013.01); *B22F 1/0044* (2013.01); *C22C 33/02* (2013.01);
(Continued)

(58) Field of Classification Search
CPC ..... H01F 1/147
See application file for complete search history.

(56) References Cited

U.S. PATENT DOCUMENTS 6,471,786 B1 * 10/2002 Shigemoto ..... B22F 1/0044 148/105
2010/0097171 A1 * 4/2010 Urata ..... C21D 8/1211 336/233
(Continued)

FOREIGN PATENT DOCUMENTS

JP H07-278764 A 10/1995
JP 2007-134591 A 5/2007
(Continued)

OTHER PUBLICATIONS

Japanese Office Action dated Nov. 6, 2018 issued in Japanese Patent Application No. 2018-113180 (with English translation).
(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes a body in which a coil portion is disposed, and external electrodes connected to the coil portion. The body includes metal particles formed of an Fe-based nanocrystal grain alloy, and the Fe-based nanocrystal grain alloy has one peak or two peaks in a differential scanning calorimetry (DSC) graph, and when the Fe-based nanocrystal grain alloy has the two peaks, a primary peak is smaller than a secondary peak, where the primary peak is at a lower temperature than the secondary peak.

16 Claims, 6 Drawing Sheets

(51) Int. Cl.

| | |
|---|---|
| ***H01F 27/255*** | (2006.01) |
| ***H01F 41/02*** | (2006.01) |
| ***H01F 1/20*** | (2006.01) |
| ***H01F 1/153*** | (2006.01) |
| ***H01F 27/29*** | (2006.01) |
| ***H01F 17/00*** | (2006.01) |
| ***C22C 33/02*** | (2006.01) |
| ***H01F 17/04*** | (2006.01) |

(52) U.S. Cl.

CPC ..... *H01F 1/153* (2013.01); *H01F 1/20* (2013.01); *H01F 17/0013* (2013.01); *H01F 17/04* (2013.01); *H01F 27/255* (2013.01); *H01F 27/292* (2013.01); *H01F 41/02* (2013.01); *B22F 1/0062* (2013.01); *C22C 2202/02* (2013.01); *H01F 2017/048* (2013.01)

(56) References Cited

U.S. PATENT DOCUMENTS

| | | | | |
|---|---|---|---|---|
| 2012/0001710 | A1 | 1/2012 | Wakabayashi et al. | |
| 2012/0274437 | A1* | 11/2012 | Matsuura | C22C 38/34 336/221 |
| 2016/0155549 | A1* | 6/2016 | Kato | B22F 3/02 336/221 |
| 2016/0217920 | A1 | 7/2016 | Choi et al. | |
| 2018/0169759 | A1* | 6/2018 | Nakamura | H01F 41/0246 |
| 2018/0330853 | A1* | 11/2018 | Egashira | C22C 38/00 |
| 2019/0009329 | A1* | 1/2019 | Jelliss | B22F 1/0062 |
| 2019/0013123 | A1* | 1/2019 | Kojima | C22C 33/0207 |
| 2019/0118265 | A1* | 4/2019 | Nie | B22F 1/0018 |
| 2019/0198208 | A1* | 6/2019 | Zakotnik | B22F 1/0018 |
| 2019/0362871 | A1* | 11/2019 | Urata | H01F 1/15308 |
| 2020/0217904 | A1* | 7/2020 | Hamada | H01F 1/15333 |
| 2020/0238374 | A1* | 7/2020 | Chiba | B22F 1/0044 |
| 2020/0243238 | A1* | 7/2020 | Kato | B22F 1/0014 |
| 2020/0373045 | A1* | 11/2020 | Ohta | B22F 1/0085 |

FOREIGN PATENT DOCUMENTS

| | | | |
|---|---|---|---|
| JP | WO2010/103709 | A1 | 9/2010 |
| JP | 2012-136770 | A | 7/2012 |
| JP | 5537534 | B2 | 7/2014 |
| JP | 2016-162947 | A | 5/2016 |
| JP | 5916983 | B2 | 5/2016 |
| KR | 10-2016-0092543 | A | 8/2016 |
| KR | 10-2016-0119039 | A | 10/2016 |

OTHER PUBLICATIONS

Office Action issued in Korean Patent Application No. 10-2017-0136768 dated Nov. 17, 2018, with English translation.

* cited by examiner

COIL COMPONENT

CROSS-REFERENCE TO RELATED APPLICATION(S)

This application claims the benefit of priority to Korean Patent Application No. 10-2017-0136768, filed on Oct. 20, 2017 in the Korean Intellectual Property Office, the disclosure of which is incorporated herein by reference in its entirety.

BACKGROUND

1. Field

The present disclosure relates to a coil component.

2. Description of Related Art

In accordance with miniaturization and thinning of electronic devices such as a digital television (TV), a mobile phone, a laptop computer, and the like, there has been increased demand for the miniaturization and thinning of coil components used in such electronic devices. In order to satisfy such demand, research and development of various winding type or thin film type coil components have been actively conducted.

A main issue depending on the miniaturization and thinning of the coil component is to maintain characteristics of an existing coil component in spite of the miniaturization and thinning. In order to satisfy such demand, a ratio of a magnetic material should be increased in a core in which the magnetic material is filled. However, there is a limitation in increasing the ratio due to a change in strength of a body of an inductor, frequency characteristics depending on insulation properties of the body, and the like.

As an example of a method of manufacturing the coil component, a method of implementing the body by stacking and then pressing sheets in which magnetic particles, a resin, and the like, are mixed with each other on coils has been used. Conventionally, ferrite has been mainly used as the magnetic particles, but recently, an attempt to use Fe-based metal powder particles excellent in terms of characteristics such as a magnetic permeability, a saturation magnetic flux density, and the like, as the magnetic particles has been conducted. However, in a case of the Fe-based metal powder particles, it is difficult to control sizes of nanocrystal grains, such that the Fe-based metal powder particles are mainly used in a metal ribbon form rather than in a powder form.

SUMMARY

An aspect of the present disclosure may provide a coil component including an Fe-based nanocrystal grain alloy having a powder form and having excellent and stable magnetic characteristics. Such a coil component may have a high magnetic permeability and direct current (DC) bias characteristics.

According to an aspect of the present disclosure, a coil component includes: a body in which a coil portion is disposed; and external electrodes connected to the coil portion, wherein the body includes metal particles formed of an Fe-based nanocrystal grain alloy, and the Fe-based nanocrystal grain alloy has one peak or two peaks in a differential scanning calorimetry (DSC) graph, and when the Fe-based nanocrystal grain alloy has the two peaks, a primary peak is smaller than a secondary peak, where the primary peak is at a lower temperature than the secondary peak.

The primary peak may have a maximum height of 80% or less of the maximum height of the secondary peak.

The maximum height of the primary peak may be 50% or less of the maximum height of the secondary peak.

The maximum height of the primary peak may be 20% or less of the maximum height of the secondary peak.

The metal particle may include nanocrystal grains formed of the Fe-based nanocrystal grain alloy, and an average size of the nanocrystal grains may be within a range from 20 nm to 50 nm.

The Fe-based nanocrystal grain alloy may be represented by a composition formula of $Fe_{(100-a-x-y-z-p-q)}CO_aSi_xB_yM_zCu_pP_q$ in which $0 \le a \le 0.5$, $2 \le x \le 17$, $6 \le y \le 15$, $0 < z \le 5$, $0.5 \le p \le 1.5$, $0 \le q \le 8$, and M is at least one element selected from the group consisting of Ti, Zr, Hf, V, Nb, Ta, Cr, Mo, and W.

The Fe-based nanocrystal grain alloy may have the one peak, and the peak may be within a range from 600° C. to 800° C.

When the Fe-based nanocrystal grain alloy has the two peaks, the primary peak may be within a range from 400° C. to 550° C.

The secondary peak may be within a range from 600° C. to 800° C.

BRIEF DESCRIPTION OF DRAWINGS

The above and other aspects, features, and advantages of the present disclosure will be more clearly understood from the following detailed description taken in conjunction with the accompanying drawings, in which:

FIGS. 6 through 9 are differential scanning calorimetry (DSC) graphs illustrating exothermic characteristics of Fe-based nanocrystal grain alloys according to Comparative Examples and Inventive Example, wherein FIGS. 6 through 8 illustrate Comparative Examples 1 to 3, respectively, and FIG. 9 illustrates Inventive Example.

DETAILED DESCRIPTION

Hereinafter, exemplary embodiments of the present disclosure will now be described in detail with reference to the accompanying drawings.

Electronic Device

Figure 1:
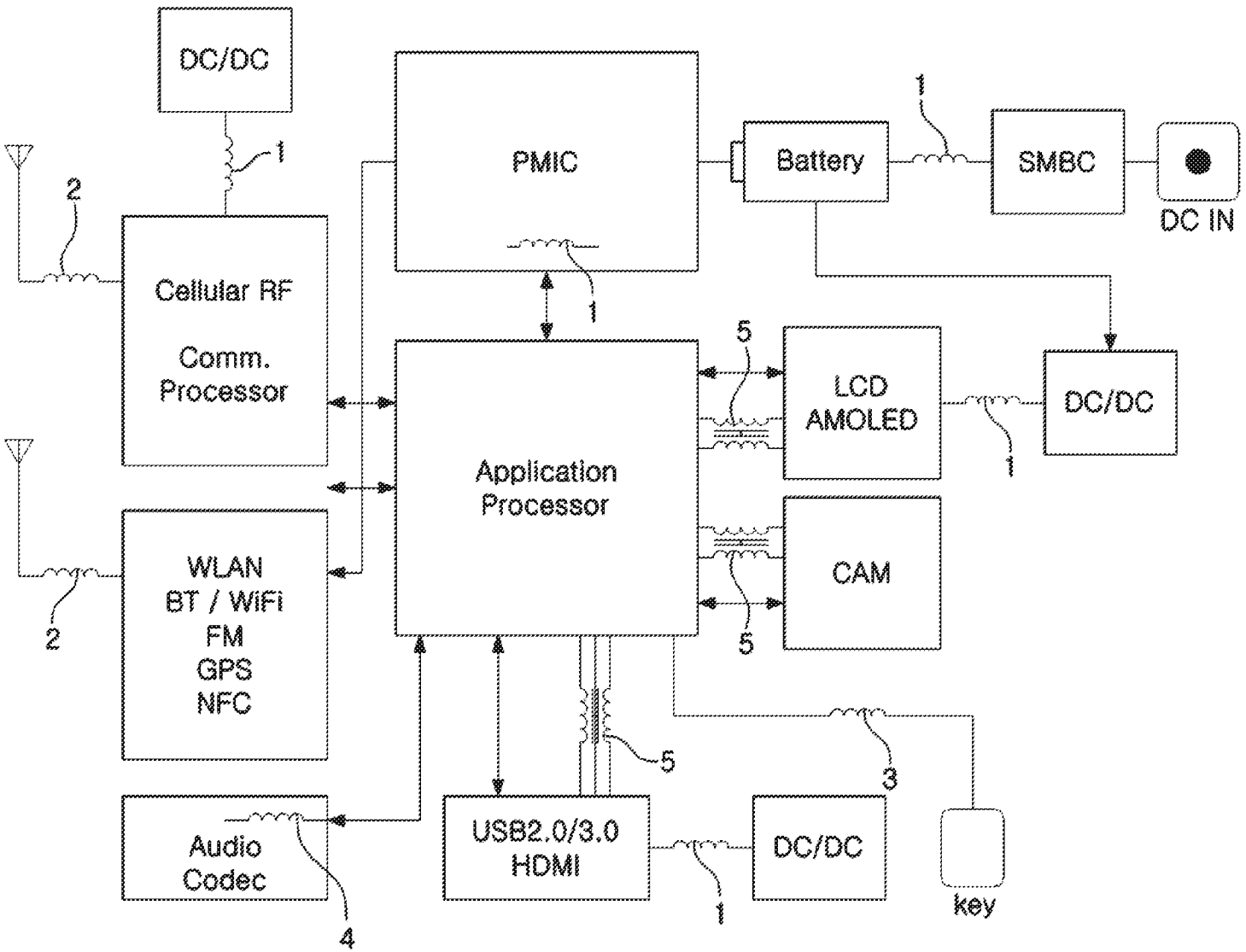
FIG. 1 is a schematic view illustrating an electronic device including an example of a coil component.

FIG. 1 is a schematic view illustrating an electronic device including an example of a coil component.

Referring to FIG. 1, it may be appreciated that various kinds of electronic components are used in an electronic device. For example, an application processor, a direct current (DC) to DC converter, a communications processor, a wireless local area network Bluetooth (WLAN BT)/wireless fidelity frequency modulation global positioning system near field communications (WiFi FM GPS NFC), a power management integrated circuit (PMIC), a battery, a SMBC, a liquid crystal display active matrix organic light emitting diode (LCD AMOLED), an audio codec, a universal serial bus (USB) 2.0/3.0 a high definition multimedia interface (HDMI), a CAM, and the like, may be used. Here, various kinds of coil components may be appropriately used between these electronic components depending on their purposes in order to remove noise, or the like. For example, a power inductor 1, high frequency (HF) inductors 2, a general bead 3, a bead 4 for a high frequency (GHz), common mode filters 5, and the like, may be used.

In detail, the power inductor 1 may be used to store electricity in a magnetic field form to maintain an output voltage, thereby stabilizing power. In addition, the high frequency (HF) inductor 2 may be used to perform impedance matching to secure a required frequency or cut off noise and an alternating current (AC) component. Further, the general bead 3 may be used to remove noise of power and signal lines or remove a high frequency ripple. Further, the bead 4 for a high frequency (GHz) may be used to remove high frequency noise of a signal line and a power line related to an audio. Further, the common mode filter 5 may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, a smartwatch, or the like. The electronic device may also be various other electronic devices well-known in those skilled in the art, in addition to the devices described above.

Coil Component

Hereinafter, a coil component according to the present disclosure, particularly, an inductor will be described for convenience of explanation. However, the coil component according to the present disclosure may also be used as the coil components for various purposes as described above.

Figure 2:
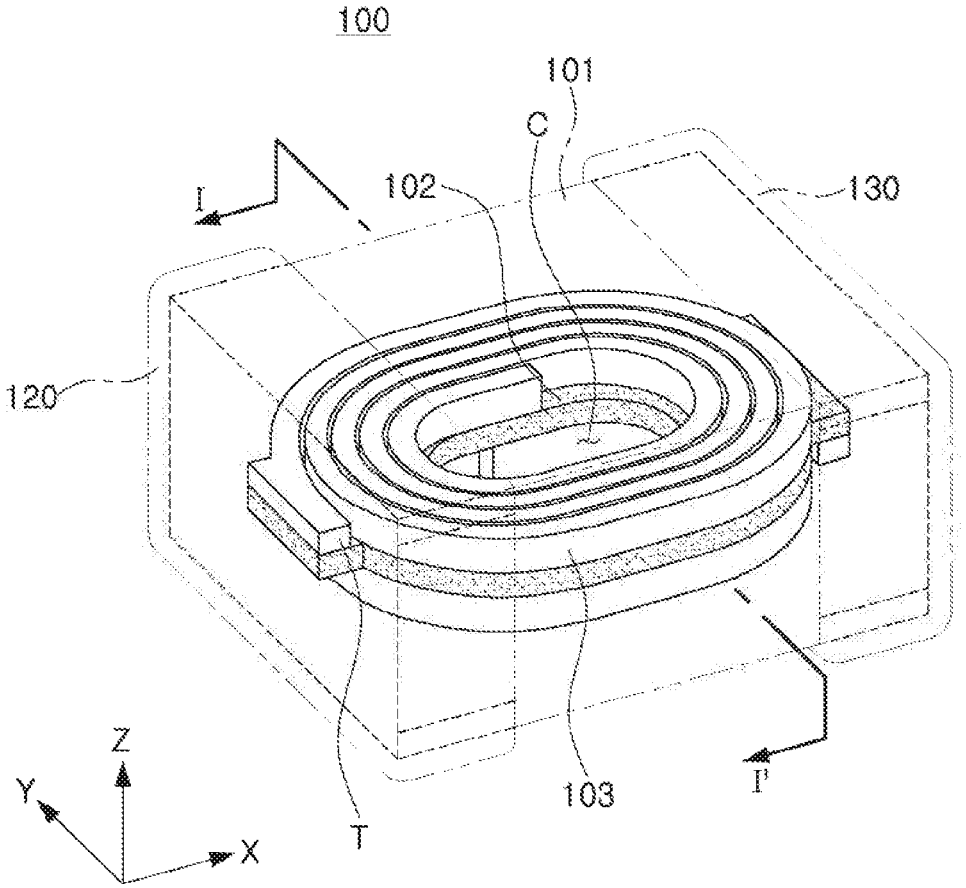
FIG. 2 is a schematic perspective view illustrating a coil component according to an exemplary embodiment in the present disclosure.
Figure 3:
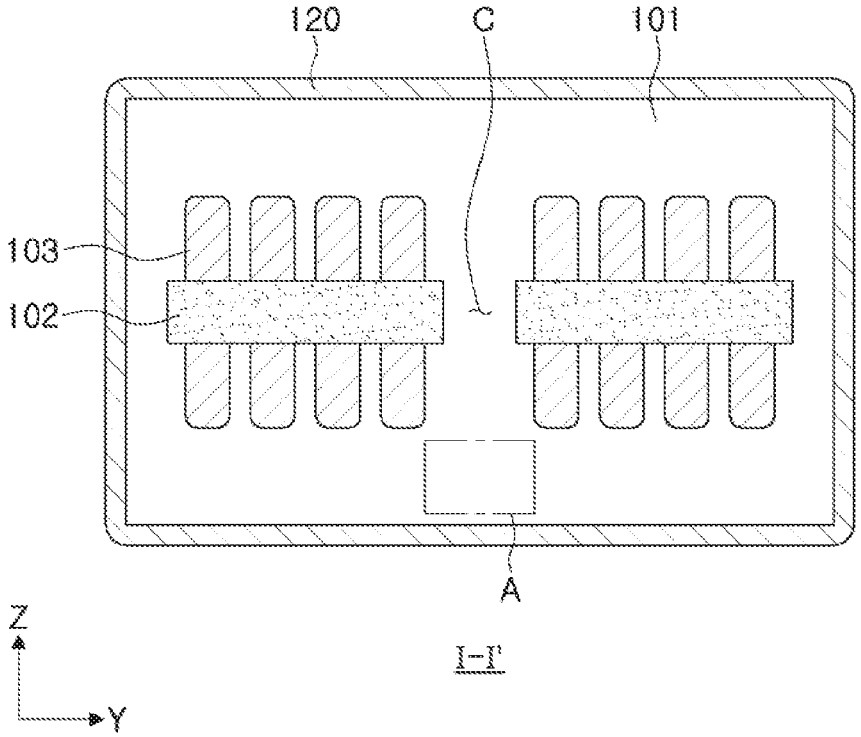
FIG. 3 is a cross-sectional view taken along line I-I' of FIG. 2.
Figure 4:
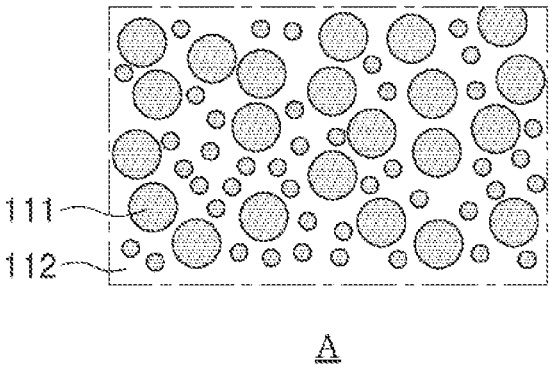
FIG. 4 is an enlarged view illustrating a body region in the coil component of FIG. 3.
Figure 5:
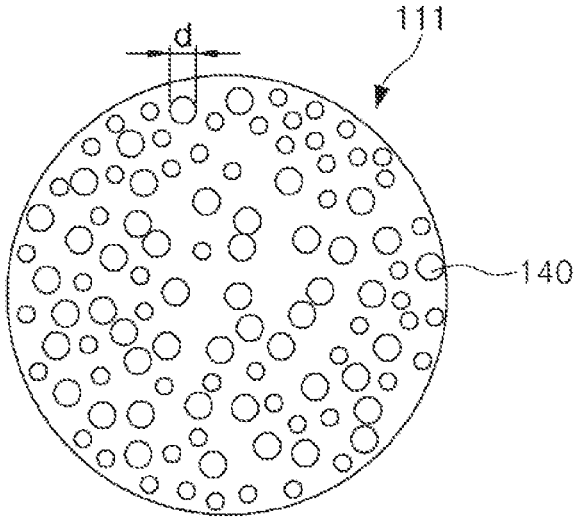
FIG. 5 is a view illustrating crystal grains included in metal particles of FIG. 4.

FIG. 2 is a schematic perspective view illustrating an appearance of a coil component according to an exemplary embodiment in the present disclosure. In addition, FIG. 3 is a cross-sectional view taken along line I-I' of FIG. 2. FIG. 4 is an enlarged view illustrating a body region in the coil component of FIG. 3, and FIG. 5 is a view illustrating crystal grains included in metal particles of FIG. 4.

Referring to FIGS. 2 and 3, a coil component 100 according to an exemplary embodiment in the present disclosure may include a body 101 in which a coil portion 103 is disposed and external electrodes 120 and 130.

The body 101 may include the coil portion 103, and may include metal particles 111 as illustrated in FIG. 4. In detail, the body 101 may have a form in which the metal particles 111 are dispersed in a base 112 formed of a resin, or the like. In this case, the metal particle 111 may be formed of an Fe-based nanocrystal grain alloy such as an Fe—Si—B—Nb—Cu-based alloy. A composition of the Fe-based nanocrystal grain alloy will be described below. In addition, the Fe-based nanocrystal grain alloy may have only one peak or two peaks in a differential scanning calorimetry (DSC) graph. When the Fe-based nanocrystal grain alloy has the two peaks, it has characteristics that a primary peak is smaller than a secondary peak. When the Fe-based nanocrystal grain alloy has the characteristics described above, sizes, phases, and the like, of nanocrystal grains are appropriately controlled, such that the Fe-based nanocrystal grain alloy shows magnetic characteristics appropriate for being used in an inductor. A detailed content for exothermic characteristics of an alloy powder will be described below.

The coil portion 103 may perform various functions in the electronic device through characteristics appearing from a coil of the coil component 100. For example, the coil component 100 may be a power inductor. In this case, the coil portion 103 may serve to store electricity in a magnetic field form to maintain an output voltage, resulting in stabilization of power. In this case, coil patterns constituting the coil portion 103 may be stacked on opposite surfaces of a support member 102, respectively, and may be electrically connected to each other through a conductive via penetrating through the support member 102. The coil portion 103 may have a spiral shape, and include lead portions T formed at the outermost portions of the spiral shape. The lead portions T may be exposed to the outside of the body 101 for the purpose of electrical connection to the external electrodes 120 and 130. The coil patterns constituting the coil portion 103 may be formed by a plating process used in the related art, such as a pattern plating process, an anisotropic plating process, an isotropic plating process, or the like, and may also be formed in a multilayer structure by a plurality of processes of these processes.

The support member 102 supporting the coil portion 103 may be formed of a polypropylene glycol (PPG) substrate, a ferrite substrate, a metal based soft magnetic substrate, or the like. In this case, a through-hole may be formed in a central region of the support member 102, and a magnetic material may be filled in the through-hole to form a core region C. The core region C may constitute a portion of the body 101. As described above, the core region C filled with the magnetic material may be formed to improve performance of the coil component 100.

The external electrodes 120 and 130 may be formed on the body 101 to be connected to the lead portions T, respectively. The external electrodes 120 and 130 may be formed of a paste including a metal having excellent electrical conductivity, such as a conductive paste including nickel (Ni), copper (Cu), tin (Sn), or silver (Ag), or alloys thereof. In addition, plating layers (not illustrated) may further be formed on the external electrodes 120 and 130. In this case, the plating layers may include one or more selected from the group consisting of nickel (Ni), copper (Cu), and tin (Sn). For example, nickel (Ni) layers and tin (Sn) layers may be sequentially formed in the plating layers.

As described above, in the present exemplary embodiment, the metal particle 111 may be formed of the Fe-based nanocrystal grain alloy, and the Fe-based nanocrystal grain alloy may have one peak or two peaks in the DSC graph. When the Fe-based nanocrystal grain alloy has the two peaks, the primary peak may be smaller than the secondary peak. In other words, crystallization energy generated at a low temperature may be smaller than that generated at a high temperature. In this case, as illustrated in FIG. 5, the metal particle 111 may include nanocrystal grains 140, and an average size d of the nanocrystal grains 140 may be within a range from about 20 nm to 50 nm.

In addition, the Fe-based nanocrystal grain alloy may be selected to have a composition range in which it is excellent in terms of characteristics such as a saturation magnetic flux density, or the like, and is appropriate for being manufactured in a powder form. In detail, the Fe-based nanocrystal grain alloy may be represented by a composition formula of $Fe_{(100-a-x-y-z-p-q)}CO_aSi_xB_yM_zCu_pP_q$ in which $0 \le a \le 0.5$, $2 \le x \le 17$, $6 \le y \le 15$, $0 < z \le 5$, $0.5 \le p \le 1.5$, $0 \le q \le 8$, and M is at least one element selected from the group consisting of Ti, Zr, Hf, V, Nb, Ta, Cr, Mo, and W.

According to research by the present inventors, it was confirmed that even though Fe-based nanocrystal grain alloy powder particles have the same component and the same size, actual precipitation aspects of crystal grains of the Fe-based nanocrystal grain alloy powder particles are different from each other, inductances or efficiencies of coil components obtained from the Fe-based nanocrystal grain alloy powder particles are different from each other, and these aspects may be recognized by measuring exothermic characteristics of the Fe-based nanocrystal grain alloy powder particles. In other words, it was difficult to accurately predict characteristics appearing in the Fe-based nanocrystal grain alloy powder particles by only a composition and a size of the Fe-based nanocrystal grain alloy powder particles, and characteristics of an inductor, such as an inductance, and the like, at the time of using the Fe-based nanocrystal grain alloy powder particles as a material of the inductor might be sufficiently predicted by revealing the exothermic characteristics of the Fe-based nanocrystal grain alloy powder particles through a thermal analysis.

Figure 6:
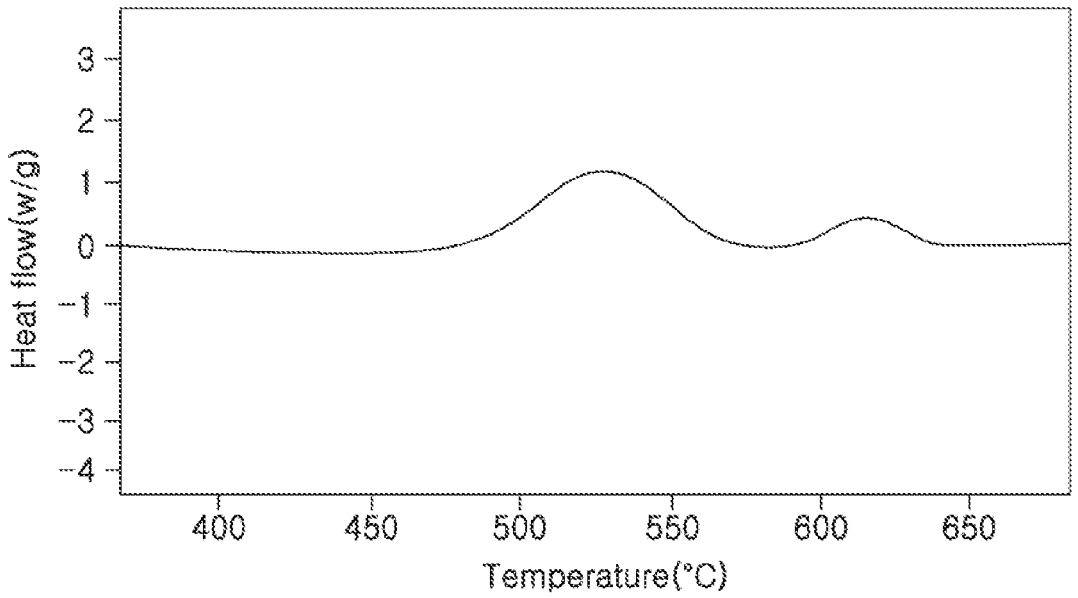
Figure 7:
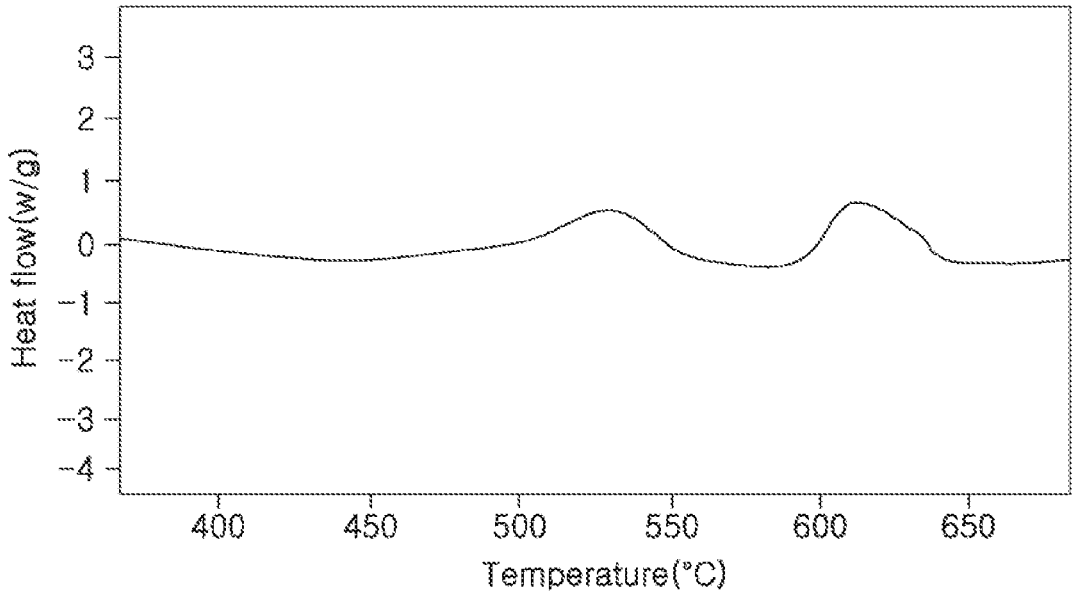
Figure 8:
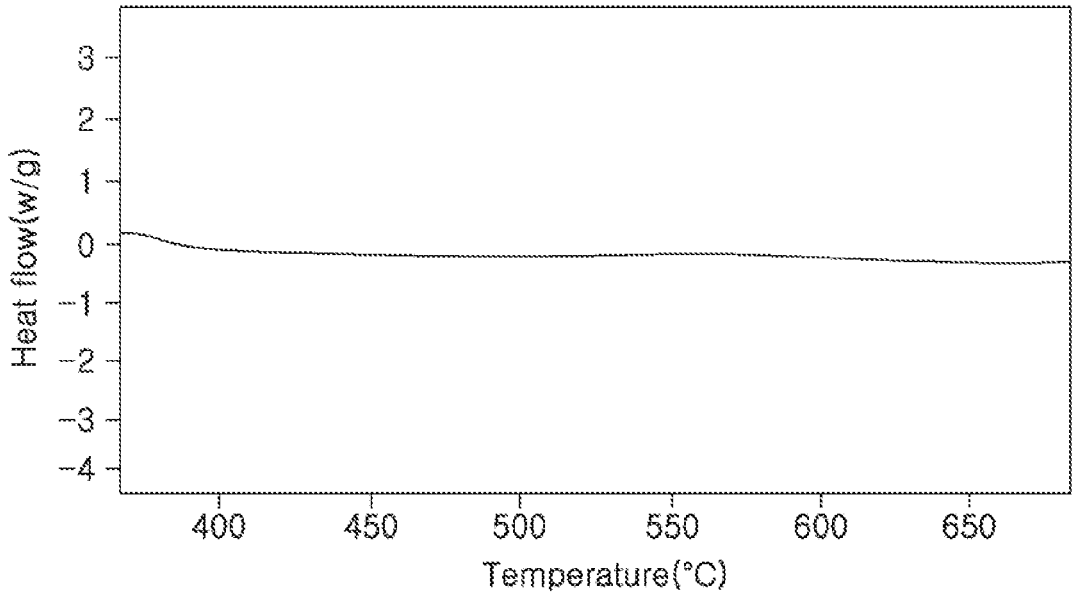
Figure 9:
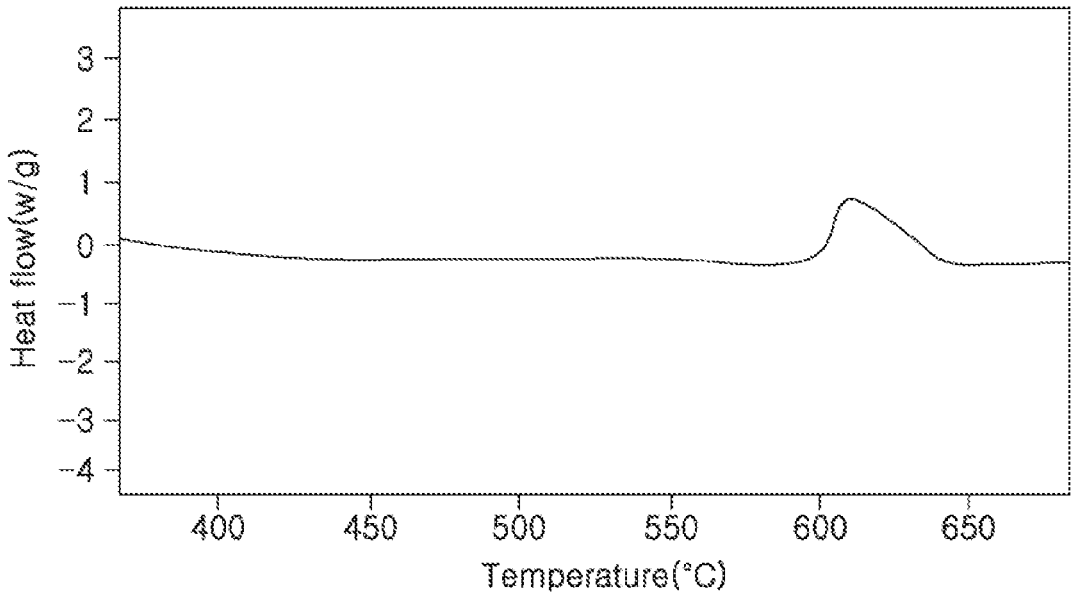

This will be described with reference to Comparative Examples 1 to 3 and Inventive Example. FIGS. 6 through 9 are DSC graphs illustrating exothermic characteristics of Fe-based nanocrystal grain alloys used in an experiment. Here, FIGS. 6 through 8 illustrate Comparative Examples 1 to 3, respectively, and FIG. 9 illustrates Inventive Example. First, a certain composition of samples used in an experiment by the present inventors was $Fe_{73.5}Si_{15.5}B_7Nb_3Cu_1$, and these samples have the same composition, but have different fine structures.

Alloy powder particles were manufactured using the samples having the different fine structures, and a thermal analysis was performed on the alloy powder particles. The thermal analysis was performed on the alloy powder particles using a product SDT600 of TA Instruments, and measurement was performed on the alloy powder particles while raising a temperature at a speed of 40° C. per minute. In addition, measurement was performed on the alloy powder particles under an argon (Ar) atmosphere so that the alloy powder particles are not oxidized. Resultantly, exothermic characteristics of the alloy powder particles were different from one another according to Comparative Examples and Inventive Example. The reason is that contents, distributions, or the like, of nanocrystal grains in the respective alloy powder particles are different from one another.

Table 1 represents characteristics (inductances and efficiencies) of inductors manufactured according to Comparative Examples and Inventive Examples, sizes of crystal grains of allow powder particles according to Comparative Examples and Inventive Examples, and crystallization energy (W/g) at the time of performing a thermal analysis on the alloy powder particles. In this case, the inductance may be evaluated using an impedance analyzer, and is determined depending on turns and a magnetic permeability of a magnetic material. When volumes of the inductors are the same as each other and turns of the inductors are the same as each other, as the magnetic permeability becomes high, the inductance is increased. The efficiency may be evaluated by measuring change amounts in voltages and currents in front of and behind a circuit, and may be calculated using a core loss value measured using an evaluation apparatus such as a B—H analyzer.

TABLE 1

| | Inductance | Efficiency | Size (nm) of Crystal | Crystallization Energy (W/g) | |
|---|---|---|---|---|---|
| | (μH) | (%) | Grain | $T_{x1}$ | $T_{x2}$ |
| Comparative Example 1 | 0.35 | 80% | 0 | 50 | 20 |
| Comparative Example 2 | 0.45 | 82% | 20 | 20 | 20 |
| Comparative Example 3 | 0.35 | 80% | 25 | 0 | 0 |
| Comparative Example 4 | 0.41 | 81% | 22 | 0 | 10 |
| Inventive Example 1 | 0.475 | 89% | 20 | 0 | 20 |
| Inventive Example 2 | 0.45 | 85% | 20 | 10 | 20 |

First, in Comparative Example 1, two prominent exothermic peaks appear, and a primary peak is greater than a secondary peak. It may be seen from such a thermal analysis result that Comparative Example 1 shows characteristics of an alloy powder in which a very small amount of nanocrystal grains are included or the nanocrystal grains do not exist. In other words, Comparative Example 1 has substantially amorphous characteristics. In this case, as illustrated in FIG. 6, high crystallization energy is generated in a process in which α-Fe (Si) is formed at the primary exothermic peak appearing in the vicinity of 500° C., and relatively low crystallization energy is generated in a process in which an Fe—B compound is formed at the secondary exothermic peak appearing in the vicinity of 600° C.

Next, alloy powder particles of the remaining Comparative Examples and Inventive Examples include nanocrystal grains through adjustment of fine structures, but have a clearly distinguished difference in a thermal analysis result or characteristics such as an inductance, or the like, therebetween. In detail, as a thermal analysis result of Comparative Example 2 (FIG. 7), two peaks appear, and a primary peak is substantially the same as a secondary peak. In Comparative Example 2, a size of nanocrystal grains is about 20 nm, but efficiency is lower than that of Inventive Example. The reason is that an amount of nanocrystal grains included in the alloy powder is small. In addition, in Comparative Example 3 (FIG. 8), an exothermic peak is not observed, and a size of the nanocrystal grains is about 25 nm, but characteristics such as an inductance, efficiency, and the like, are not good, and a sample of Comparative Example 4 shows similar results. The reason is that in samples of Comparative Examples 3 and 4, a plurality of Fe—B compounds are formed, such that magnetic permeabilities are decreased and loss is increased.

In Inventive Example 1, as illustrated in a graph of FIG. 9, a single peak, that is, one exothermic peak appears, and corresponds to a peak appearing in the vicinity of about 600° C. It may be seen that a large amount of α-Fe (Si) phases exist and Fe—B compounds do not exist or a small amount of Fe—B compounds exist, from the fact that a peak does not exist in the vicinity of 500° C. and the peak appears in the vicinity of 600° C., and in such an alloy powder, both of an inductance and an efficiency are excellent. Likewise, Inventive Example 2 having a primary peak (10 W/g) being smaller than a secondary peak (20 W/g) shows an enhanced efficiency compared to the Comparative Examples. Inventive Example 2 can have a DSC graph similar to Comparative Example 2 (FIG. 7) and can have a primary peak within a range from 400° C. to 550° C.

It may be seen from the experimental results described above that when the Fe-based nanocrystal grain alloy having the powder form has the single peak in the DSC graph, the inductance and the efficiency are excellent. In this case, an average size of nanocrystal grains included in the alloy powder is within a range from about 20 nm to 50 nm. In this case, in Inventive Example, the single peak is around 600° C., and the single peak may more generally have a range of 600° C. to 800° C.

In addition, the Fe-based nanocrystal grain alloy having the powder form described above does not necessarily have the single peak in the DSC graph, but may also have two peaks. However, also in this case, a maximum height of a primary peak needs to be smaller than a secondary peak. In detail, the maximum height of the primary peak may be 80% or less of the maximum height of the secondary peak. Preferably, the maximum height of the primary peak may be 50% or less of the maximum height of the secondary peak, and most preferably, the maximum height of the primary peak may be 20% or less of the maximum height of the secondary peak. Since the alloy powder having the exothermic characteristics described above does not include Fe—B compounds or a very small amount of Fe—B compounds, it may have excellent magnetic characteristics. Here, when exothermic characteristics related to precipitation of different phases when the Fe-based nanocrystal grain alloy has the two peaks are generalized, the primary peak may be within a range from 400° C. to 550° C., and the secondary peak may be within a range from 600° C. to 800° C.

As described above, the Fe-based nanocrystal grain alloy suggested in the present exemplary embodiment may include a large amount of α-Fe (Si) phases, such that the primary peak generated at the time of precipitating the α-Fe (Si) phases does not exist or is very small. On the other hand, the Fe-based nanocrystal grain alloy may not include Fe—B compounds or may include a very small amount of Fe—B compounds, such that the secondary peak generated at the time of precipitating the Fe—B compounds is relatively large. In addition, when the Fe-based nanocrystal grain alloy is manufactured in the powder form, it may include the nanocrystal grains, and show excellent and stable magnetic characteristics. In addition, the coil component implemented by the Fe-based nanocrystal grain alloy may have a high magnetic permeability and direct current (DC) bias characteristics.

As set forth above, in the coil component according to the exemplary embodiment in the present disclosure, the Fe-based nanocrystal grain alloy having the powder form, having the excellent and stable magnetic characteristics may be used to improve the magnetic permeability and the DC bias characteristics of the coil component.

While exemplary embodiments have been shown and described above, it will be apparent to those skilled in the art that modifications and variations could be made without departing from the scope of the present invention as defined by the appended claims.

What is claimed is:

1. A coil component comprising:

a body in which a coil portion is disposed; and external electrodes connected to the coil portion, wherein the body includes metal particles formed of an Fe-based alloy, the Fe-based alloy has one peak or two peaks in a differential scanning calorimetry (DSC) graph, and when the Fe-based alloy has the two peaks, a primary peak is smaller than a secondary peak, where the primary peak is at a lower temperature than the secondary peak, and the Fe-based alloy has the one peak in a differential scanning calorimetry (DSC) graph within a range from 600° C. to 800° C. without a peak less than 600° C.

2. The coil component of claim 1, wherein the Fe-based alloy has the two peaks, and a maximum height of the primary peak is 80% or less of a maximum height of the secondary peak.

3. The coil component of claim 1, wherein the Fe-based alloy has the two peaks, and the maximum height of the primary peak is 50% or less of the maximum height of the secondary peak.

4. The coil component of claim 1, wherein the Fe-based alloy has the two peaks, and the maximum height of the primary peak is 20% or less of the maximum height of the secondary peak.

5. The coil component of claim 1, wherein the metal particle includes nanocrystal grains formed of the Fe-based alloy, and an average size of the nanocrystal grains is within a range from 20 nm to 50 nm.

6. The coil component of claim 1, wherein the Fe-based alloy is represented by a composition formula of $Fe_{(100-a-x-y-z-p-q)}Co_aSi_xB_yM_zCu_pP_q$ in which $0 \le a \le 0.5$, $2 \le x \le 17$, $6 \le y \le 15$, $0 < z \le 5$, $0.5 \le p \le 1.5$, $0 \le q \le 8$, and M is at least one element selected from the group consisting of Ti, Zr, Hf, V, Nb, Ta, Cr, Mo, and W.

7. The coil component of claim 1, wherein the Fe-based alloy has the two peaks.

8. The coil component of claim 7, wherein the secondary peak is within a range from 600° C. to 800° C.

9. An Fe-based alloy represented by a composition formula of $Fe_{(100-a-x-y-z-p-q)}Co_aSi_xB_yM_zCu_pP_q$ in which $0 \le a \le 0.5$, $2 \le x \le 17$, $6 \le y \le 15$, $0 < z \le 5$, $0.5 \le p \le 1.5$, $0 \le q \le 8$, and M is at least one element selected from the group consisting of Ti, Zr, Hf, V, Nb, Ta, Cr, Mo, and W, wherein the Fe-based alloy has one peak or two peaks in a differential scanning calorimetry (DSC) graph, and the Fe-based alloy has the one peak in a differential scanning calorimetry (DSC) graph within a range from 600° C. to 800° C. without a peak less than 600° C.

10. The Fe-based alloy of claim 9, wherein the Fe-based alloy has the two peaks, and a primary peak is smaller than a secondary peak.

11. The Fe-based alloy of claim 9, wherein the Fe-based alloy has the two peaks, and a maximum height of the primary peak is 80% or less of a maximum height of the secondary peak.

12. The Fe-based alloy of claim 9, wherein the Fe-based alloy has the two peaks, and the maximum height of the primary peak is 50% or less of the maximum height of the secondary peak.

13. The Fe-based alloy of claim 9, wherein the Fe-based alloy has the two peaks, and the maximum height of the primary peak is 20% or less of the maximum height of the secondary peak.

14. The Fe-based alloy of claim 9, wherein the Fe-based alloy includes nanocrystal grains, and an average size of the nanocrystal grains is within a range from 20 nm to 50 nm.

15. The Fe-based alloy of claim 9, wherein the Fe-based alloy has the two peaks.

16. The Fe-based alloy of claim 15, wherein the secondary peak is within a range from 600° C. to 800° C.

* * * * *